United States Patent [19]

Bujese

[11] Patent Number: 5,049,942

[45] Date of Patent: Sep. 17, 1991

[54] ELECTROSTATIC TRANSFER DEVICE

[75] Inventor: David P. Bujese, Southington, Conn.

[73] Assignee: Olin Corporation, Cheshire, Conn.

[21] Appl. No.: 459,881

[22] Filed: Jan. 2, 1990

Related U.S. Application Data

[63] Continuation-in-part of Ser. No. 178,652, Apr. 7, 1988, Pat. No. 4,921,772.

[51] Int. Cl.[5] ..... G03G 15/16

[52] U.S. Cl. ..... 355/272; 101/DIG. 37

[58] Field of Search ..... 355/272, 271, 274; 118/621; 101/DIG. 37; 430/126

[56] References Cited

U.S. PATENT DOCUMENTS

| | | | |
|---|---|---|---|
| 3,267,840 | 8/1966 | Honma et al. . | |
| 3,526,191 | 9/1970 | Silverberg et al. . | |
| 3,615,128 | 10/1971 | Bhagat . | |
| 3,795,442 | 3/1974 | Kimura et al. . | |
| 4,171,157 | 10/1979 | Suzuki | 355/3 TR |
| 4,182,266 | 1/1980 | Alston | 118/621 |
| 4,245,555 | 1/1981 | Alston | 101/466 |
| 4,556,309 | 12/1985 | Weber et al. . | |
| 4,708,460 | 11/1987 | Langdon | 355/10 |
| 4,763,157 | 8/1988 | Bujese | 355/3 TR |
| 4,793,255 | 12/1988 | Bujese et al. | 355/77 |
| 4,855,784 | 8/1989 | Bujese | 355/272 |
| 4,894,686 | 1/1990 | Bujese | 355/271 |

*Primary Examiner*—R. L. Moses

*Attorney, Agent, or Firm*—H. Samuel Kieser

[57] ABSTRACT

An apparatus to perform the electrostatic transfer of a developed image from a master having a permanent latent image therein to a receiving surface in which the master is moved between a first position remote from said receiving surface to a second position in overlying relation with said receiving surface for image transfer. A wicking station is moveable between a first position and a second position to deposit an insulating solvent on said receiving surface and return to its first position at a slower speed than the speed of the master returning to its first position. Gap spacer strips are provided which are played out over the receiving surface as the wicking station moves to its second position. The gap spacer strips in combination with a drive motor serve to return the wicking station to its first position.

17 Claims, 10 Drawing Sheets

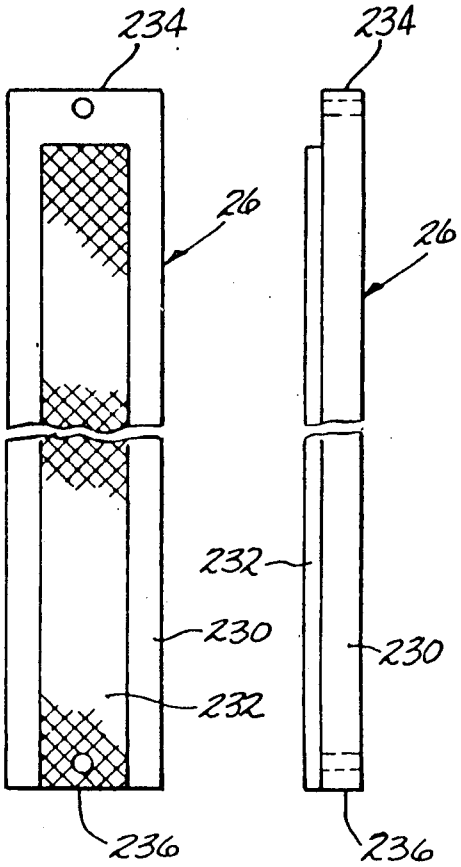
FIG-14
FIG-13
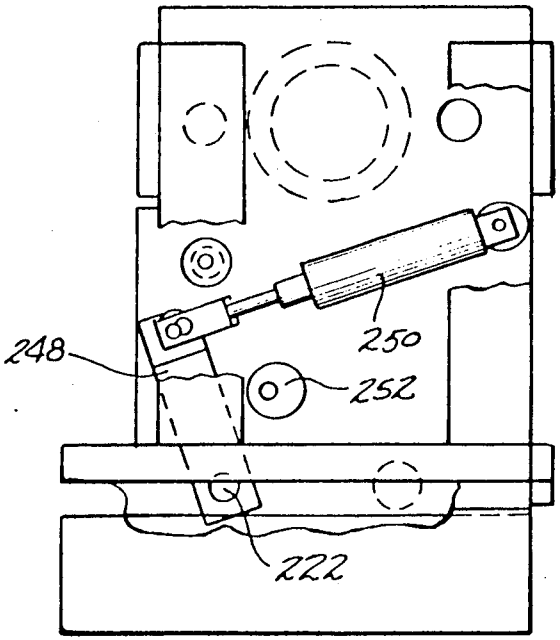
FIG-12
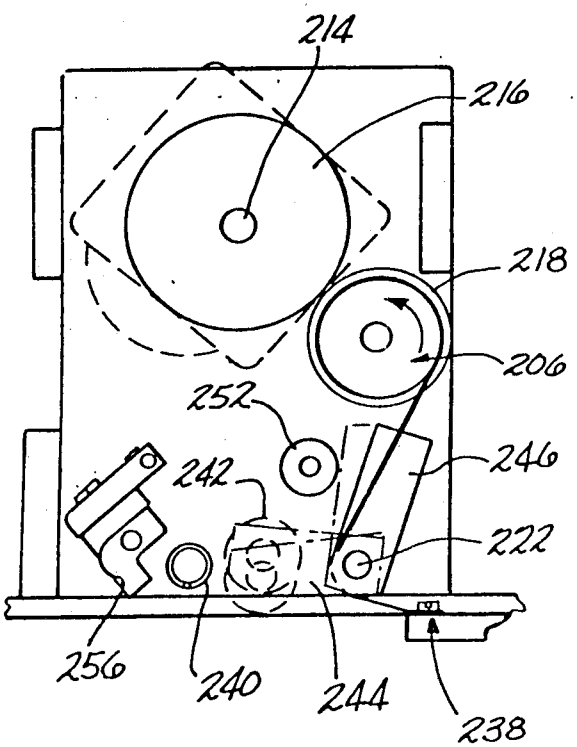
FIG-11

ELECTROSTATIC TRANSFER DEVICE

This apparatus is a continuation-in-part of copending prior application Ser. No. 07/178,652 filed Apr. 7, 1988, U.S. Pat. No. 4,921,772.

This invention relates generally to an apparatus for electrostatically developing and transferring a developed image from a master to a receiving surface. More specifically, it relates to a wicking station and gap spacer strip for use in such apparatus.

An apparatus incorporating the present invention transports a master in a first direction, while applying a charge and developing the charged master with toner particles, and in the second direction transfers the developed image to the receiving surface from a stationary master. The master is cleaned while the master returns in the second direction. The method and apparatus are used in the transfer of a high resolution image to a receiving surface in either a single or multiple imaging mode.

The permanent master and the substrate supporting the permanent master are used as part of a system to repeatedly produce high resolution and high quality images on receiving surfaces. These receiving surfaces can be conductive, such as printed circuit boards, or non-conductive, such as paper or plastic which may be used in color graphic applications. Conductive receiving surfaces, such as printed circuit boards, have traditionally been produced by individually laminating, exposing, developing, etching and stripping processes where dry film photoresist has been used to produce the conductive wiring patterns. Previously, however, there has been no method or apparatus available to produce a plurality of copies of conductive wiring patterns from a single master copy of the desired wiring pattern utilizing photoimaging and a photopolymer in an apparatus that occupied a relatively small "footprint" in a manufacturing environment. There are many other factors which have prevented this type of system from being employed in manufacturing multiple copies from a single master.

Similarly, the use of an apparatus employing a photopolymer in conjunction with non-conductive receiving surfaces, such as those used in color graphics, has not previously been possible in a small "footprint" apparatus that provided high speed and high quality copies. Offset lithography has utilized an apparatus and method that employs two directionally operating image transfer systems with a transfer roller.

In the apparatus of the above type, it is necessary to provide a uniform layer of non-polar insulating solvent to the receiving surface prior to image transfer. This layer should be applied with an even predetermined thickness to facilitate gap transfer. In addition, it is necessary to provide a physical gap between the master containing the developed image and the image receiving surface.

Accordingly, it is an object of the present invention to provide an apparatus for electrostatically developing and transferring the developed image to a receiving surface which includes means for providing a uniform layer of solvent on the imaging receiving surface.

Another object of the present invention is to provide an apparatus for electrostatically developing and transferring a developed image from a master to a receiving surface in which a physical gap is maintained between the master and the receiving surface during transfer thereof.

A further object of the present invention is to provide an apparatus for electrostatically developing and transferring a developed image from a master to a receiving surface in which a moveable wicking station is employed to apply a solvent to the receiving surface prior to image transfer while moving in one direction and in which the wicking station is moveable at a speed different than that of the master after the application of the solvent while it is moving in the opposite direction. These and other objects and advantages of the present invention may be accomplished through the provision of an apparatus for transferring an image from a master to a receiving surface which includes means for moving a master from a first position to a second position whereat said receiving surface and said master are in overlying relationship and returning the master to its first position. A frame assembly is provided on which a moveable member is mounted. Gap spacers in the form of elongated strips are mounted in a moveable member and extendable therefrom with the ends extending from said moveable member attached to the frame assembly. Means are provided for moving the moveable member from a first position wherein the gap spacers are remote from said receiving surface to a second position wherein said gap spacers extend over said receiving surface as said master moves to its second position so the gap spacers are positioned between the receiving surface and said master to maintain a gap therebetween during transfer of the image.

As a further feature of the invention, the apparatus may include a wicking station moveable on the frame member from a first position to a second position wherein the wicking station passes over the receiving surface to deposit a solvent on the receiving surface. Means may be provided for moving the wicking station in the first direction and means are provided for moving the wicking station back to its first position at a speed independent of the speed of the master moving in its second direction.

The objects, features and advantages of the present invention will become apparent upon consideration of the following detailed disclosure of the invention, especially when it is taken in conjunction with the accompanying drawings wherein:

FIG. 11 is a side elevational view looking in the direction 11—11 of FIG. 9;

FIG. 12 is a side elevation view looking in the direction 12—12 of FIG. 9;

FIG. 13 is a bottom plan view of a gap spacer strip used in the present invention; and FIG. 14 is a side view of the gap spacer strip of FIG. 13.

Figure 1:
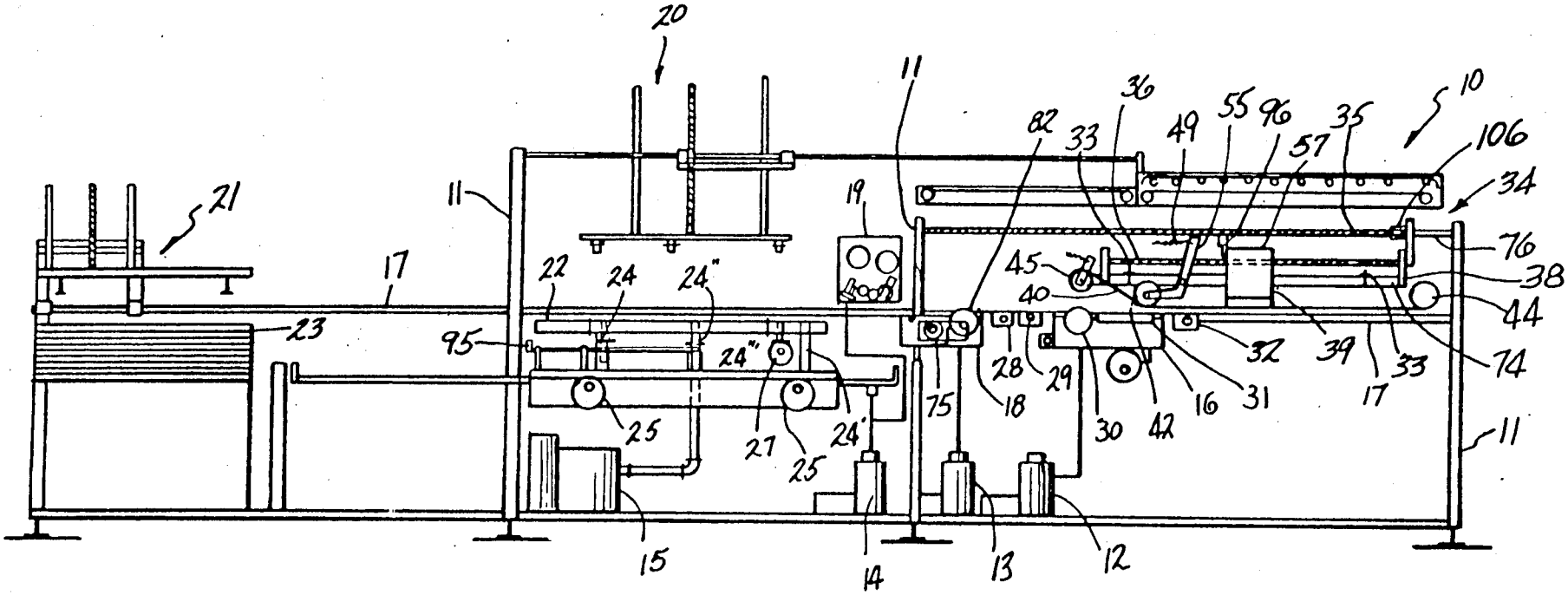
FIG. 1 is a side elevational view of the apparatus used to transfer electrostatically developed images from the master that is retained on the flexible substrate to a receiving surface.

Referring to the drawings, FIG. 1 shows a side elevational diagrammatic illustration of the electrostatic imaging apparatus, indicated generally by the numeral 10. Apparatus 10 has a support frame 11 to which are mounted toner tank assembly 12, cleaning station tank and feed line assembly 13, non-polar insulating solvent tank assembly 14, and vacuum pump assembly 15. Each of the tank assemblies 12, 13 and 14 have appropriate hoses and pumps to either distribute the toner to the toning station 16 or the non-polar insulating solvent to the master cleaning station 18 and wicking station 19, respectively. Apparatus 10 at the infeed end has a board feeder unit 21 which picks up individual conductive receiving surfaces 23, such as copper boards, or non-conductive materials depending upon the application, by appropriate means, such as suction or vacuum pickup, and transports it along guide rails 17 to a board receiving station or stationary platen 22, where it is correctly positioned by alignment pins 24. After image transfer to the conductive receiving surface 23 has been completed, a board pickup unit 20 removes the imaged receiving surface 23 from the platen 22 in preparation for receipt of the next receiving surface 23 for imaging.

A permanent master is used to produce the desired image on each copper board 23. The permanent master is a multiple layered structure having a base layer of a suitable flexible and non-conductive plastic, such as a polyethylene terephthalate sold under the tradename Mylar ®, which is coated with an electrically conductive layer, such as a silver or aluminum layer, and a layer of photosensitive material, such as dry film or liquid photoresist. The permanent master is produced by exposing the desired pattern, such as through a mask, to actinic radiation. The exposed pattern on the electrostatically imageable surface of the master, once thus cross-linked, creates a persistent latent image with permanently increased electrical resistivity. This latent image will hold an electrostatic charge when exposed to a charging apparatus, such as corona 32. The charged latent image attracts the toner particles of an appropriate toner when the master 48, with the image thereon, is passed through toning station 16.

Figure 2:
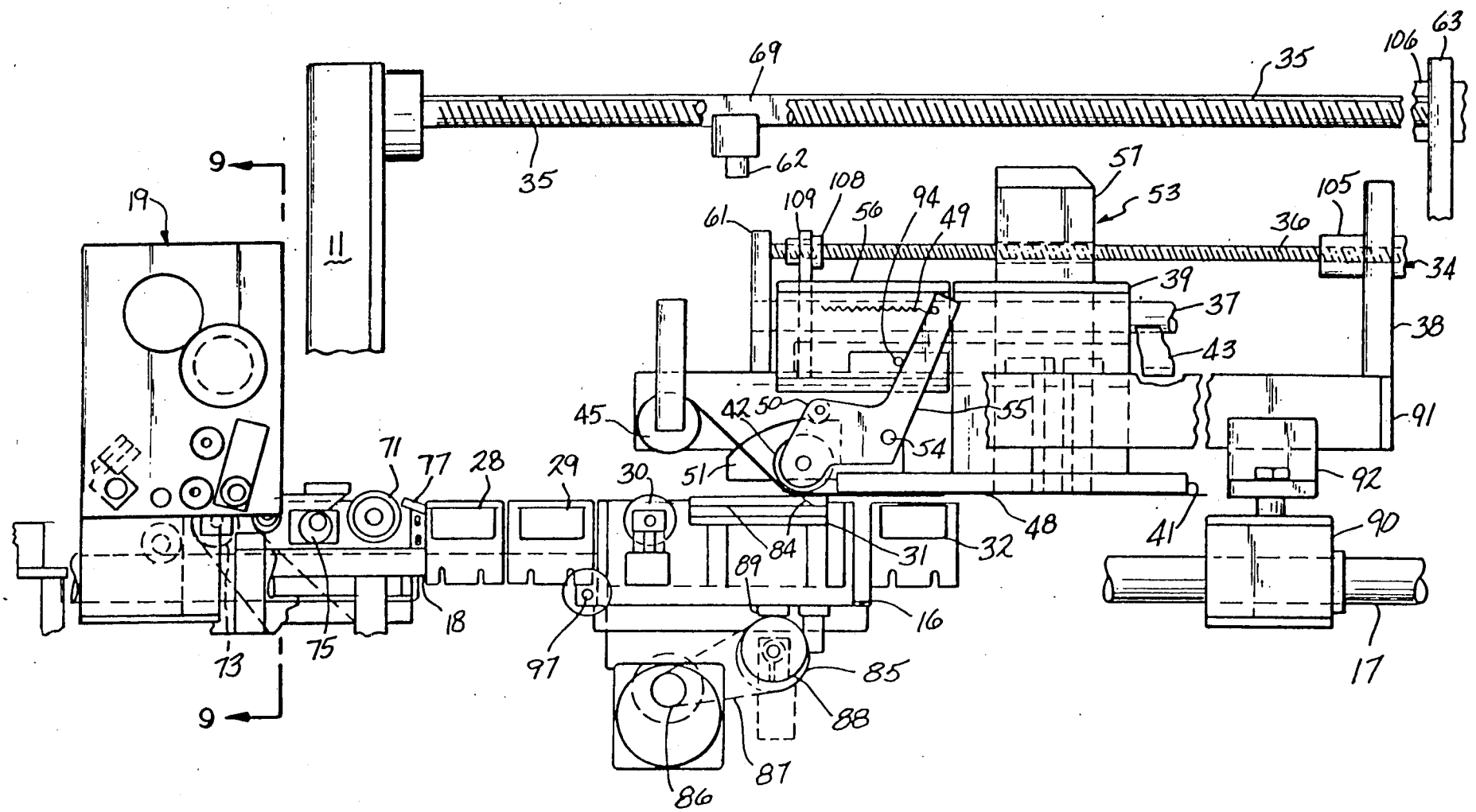
FIG. 2 is an enlarged side elevational view of the apparatus used to effect the transfer of the image at the beginning of the imaging cycle during charging.

The master, seen as 48 in FIG. 2, is placed on a stationary platen 22 of FIG. 1 with the photosensitive surface down prior to the picking up of any of the conductive receiving surfaces 23. Previously, an alignment template (not shown) has been used to adjust all of the alignment pins 24, 24', 24'', and 24''' to fit within the holes in the heavy metal template that is placed over the raised pins on the platen 22. The position of alignment pins 24, 24', 24'', and 24''' may be adjusted by means of adjustment screws (not shown) beneath platen 22.

Once proper adjustment has been achieved, the template is removed and the master registration process is accomplished. First a dummy receiving surface or punch guide (not shown) is placed on the platen 22. This surface is the same thickness as the receiving surfaces 23 which will be employed during the actual image transfer process. The dummy receiving surface has a plurality of vacuum holes (not shown) about its perimeter. The permanent master 48 has previously had its photosensitive surface exposed to obtain the difference in electrical resistivity required for the process by the cross-linking of the exposed surface area to obtain the permanent latent image desired.

Alignment pins 24 are then raised to register the master 48 and the dummy receiving surface to the platen 22. Alignment pins 24 register the master 48 to the platen through an adaptation of the standard four (04) slot system. This adaptation results in a "T" design that utilizes 3 slots and the corresponding pins 24, along one edge and a single slot and pin 24 at the base of the "T". This permits two sides of a receiving surface 23 to be precisely imaged, such as with dual sided circuit boards, even when two different masters are used and to permit variable width receiving surfaces 23 to be used. This "T" design pin arrangement simplifies the registration system.

Alignment pins 24, 24'', 24'' and 24''' comprise four sets which may be selected by cam control rods 95, only one of which is shown in FIG. 1, depending on the size of the surface to be registered. The alignment pins 24 are used to register the 24''×30'' long master to the receiving surface. The master 48 is always the same size to ensure that the full width of the carrier means 40, preferably in the form of a web, is covered to prevent the buildup of contaminants between the master 48 and the carrier web means 40. By selection of the appropriate alignment pins 24, 24', 24'' and 24''' receiving surfaces 23 of a width of 12 inches, 16 inches, 18 inches or 24 inches, for example, may be selected and registered on the platen 22 for either 18 or 24 inch length boards. Alignment pins 24 and 24' are always actuated regardless of the size of the receiving surface.

Once properly registered by having the pins position and retain the master 48 and the dummy receiving surface (not shown) in position, the vacuum pump apparatus 15 is activated to hold both the dummy receiving surface and the master 48 in place. Perimeter vacuum holes in the dummy receiving surface permit the suction to retain the master 48 in its proper position through the dummy receiving surface. Platen 22 has a plurality of holes (not shown) which permits the vacuum pump assembly 15 to suction out the air from the platen vacuum chambers (not shown) from beneath the dummy receiving surface to hold it in place. Alignment pins 24 thus assure that the master 48 is properly positioned on the stationary platen 22 via the use of pin contact plate cams 25, dielectric cam contact blocks 90 and pin contact plate 94, best seen in FIGS. 1 and 6, or other appropriate apparatus. Alignment pins 24, 24', 24'' and 24''' prevent movement of the master 48, as well as the receiving surface 23 after the master 48 is picked up by the carrier means 40, in the horizontal direction in the X and Y planes, on the stationary platen 22.

The master 48 is then picked up by the carrier means 40 by having the master transport assembly, indicated generally by the numeral 34, move over the platen 22 being driven along guide rails 17 by master transport assembly drive motor 106 and the main drive screw shaft 35 of FIG. 1. The master transport assembly 34 is aligned and registered to the master 48 and platen 22 by the engagement of alignment pins 33 of FIG. 1 on the master transport assembly 34 with the pin receptacles (not shown). Alignment pins 33 are raised or lowered by air cylinders 102 (one of which is seen in FIG. 5). Once lowered, the pins 33 register the master transport assembly 34 with the carrier means 40 to the platen 22 and prevent movement in the horizontal direction in the X and Y planes. As seen partially in FIGS. 2–7, master transport assembly 34 travels along guide rails 17 via transport assembly bearings 90 (only one of which is shown). Bearings 90 are connected by support brackets 92 and an appropriate fastener, such as a bolt or pin, to transport assembly support members 91 (only one being shown for all of the items).

An electrical charge is supplied to the carrier web means 40, which is formed from the aforementioned flexible, non-conductive material having a conductive coating. The electrical charge is carried by the conductive coating and creates the electrostatic force which picks up and holds the master 48 on the carrier web means 40. The master transport assembly 34, with the master 48 held in place on the carrier web means 40 as seen in FIG. 2, then returns to the start position shown in FIG. 1.

A conductive receiving surface 23, such as a copper circuit board which is preferably two-sided, is placed on the platen 22 of FIG. 1 and is registered so it will be precisely aligned with the master 48 by the alignment pins 24 that are positioned by means of cams 27, or other appropriate apparatus. The position of the platen 22 can be controlled by any appropriate apparatus, such as cams 25, if necessary. Dielectric standoffs 82 (seen in FIGS. 5 and 6) can be used to electrically isolate platen 22.

The master transfer assembly 34, once the receiving surface 23 is properly positioned on platen 22, carries the carrier web means 40 and the master 48 in a first direction toward the platen 22. The master 48, as seen in FIGS. 2–7, passes over the charging corona 32, which charges the permanent latent image on the master 48, and then passes over the development or toning station 16, which includes reversing roller 30 and development toner electrode 31, to develop the permanent latent image. Toner is fed out of the slots 84 at an angle to ensure the surface of the development electrode 31 is completely coated during development of the master 48. The toner is pumped from the toner tank assembly 12 of FIG. 1. Reversing roller 30 is appropriately driven, such as by a pair of reversing roller drive sprockets that are in turn driven by a drive motor and drive chains, all not shown. A spur gear (not shown) may be used with the drive sprocket to drive reversing roller 30.

Figure 3:
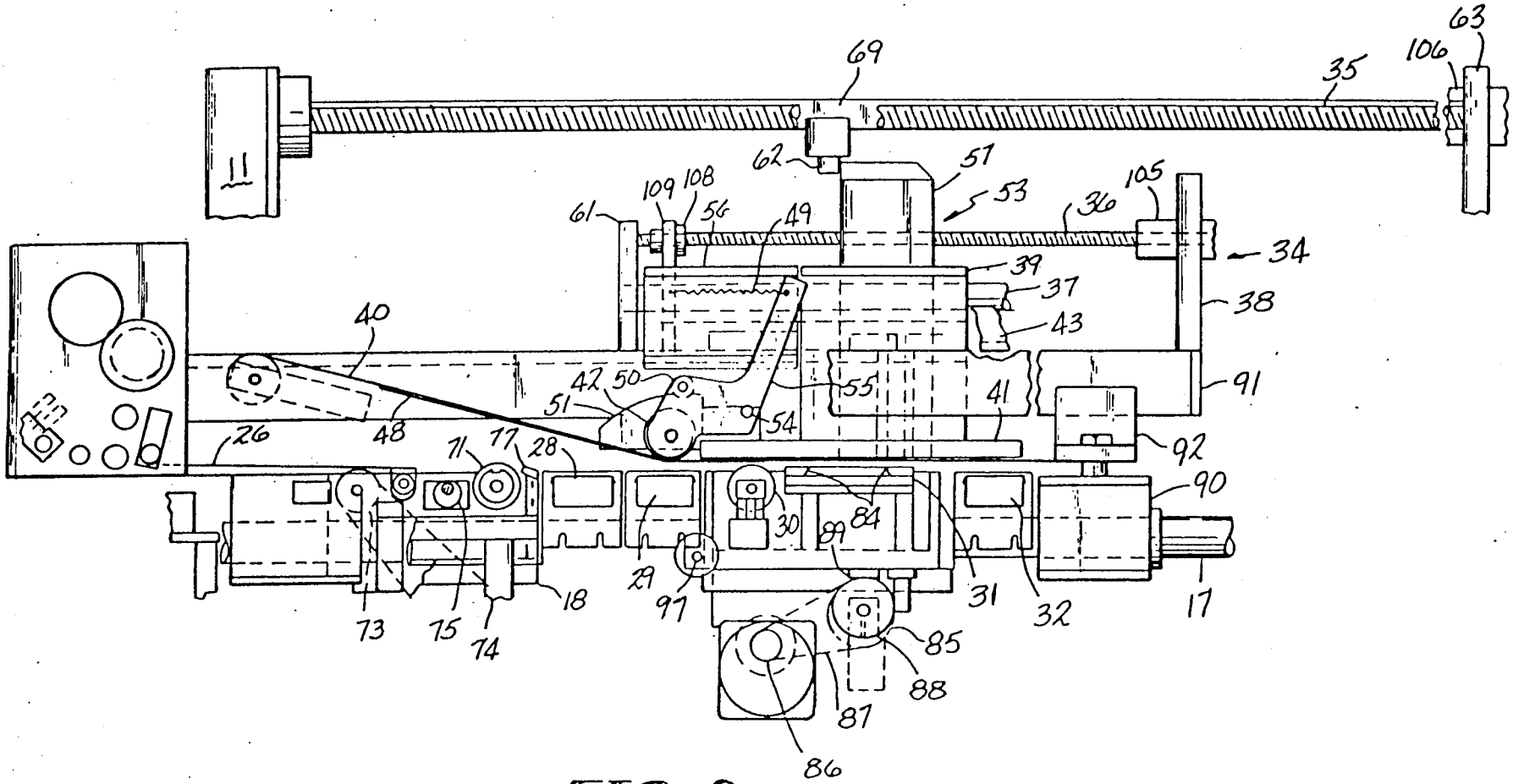
FIG. 3 is an enlarged side elevational view of the apparatus at the beginning of the development cycle of the electrostatic master.
Figure 4:
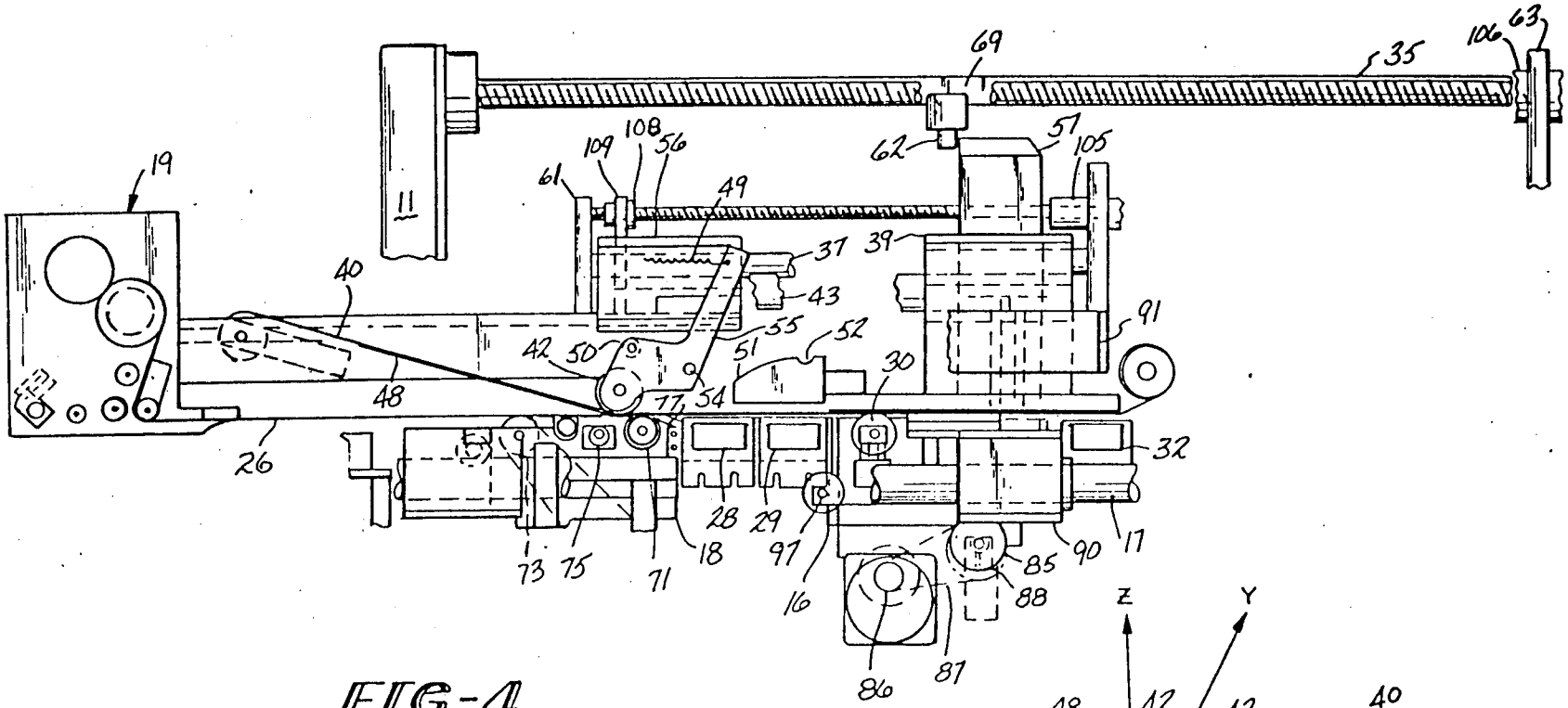
FIG. 4 is an enlarged side elevational view of the apparatus at the end of the development cycle of the electrostatic master.
Figure 5:
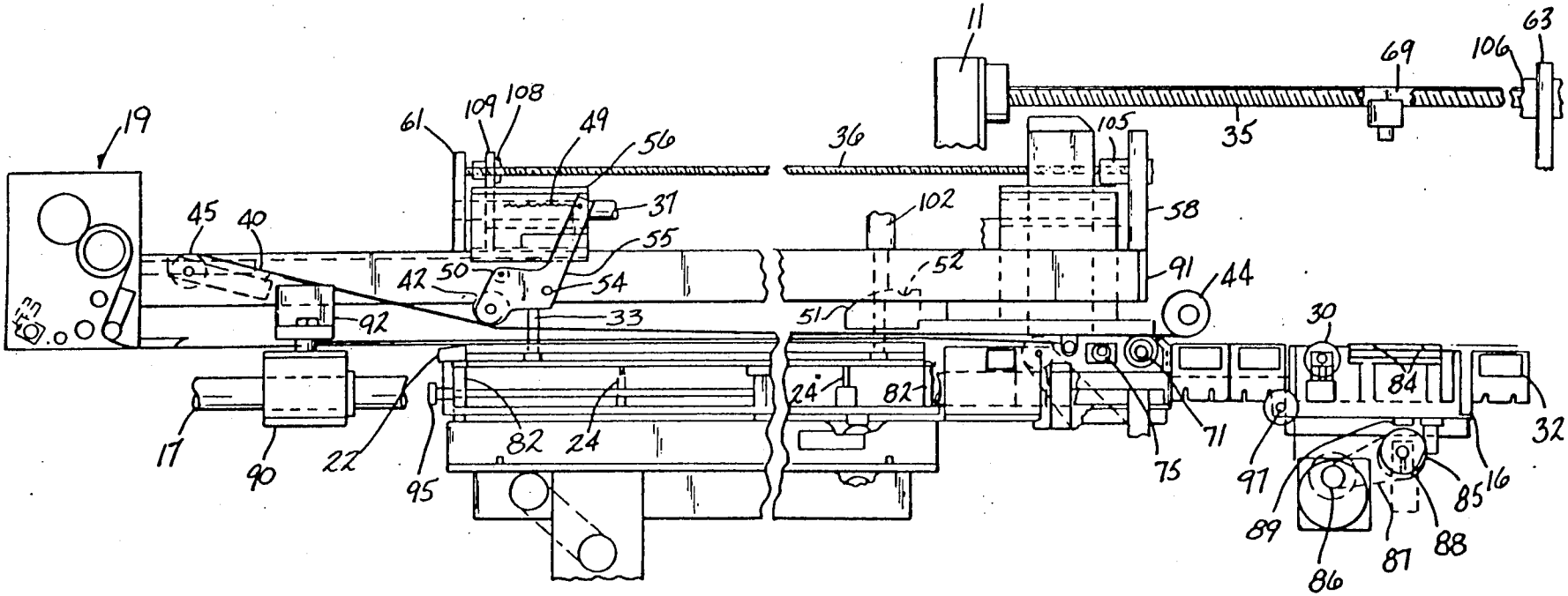
FIG. 5 is an enlarged side elevational view of the apparatus at the beginning of the transfer cycle transferring the developed image from the electrostatic master to the receiving surface.

FIGS. 2–4 show the progression of the transfer means 53, which includes transfer roller 42 and carrier web backing means or backing plate 41, as it is driven in the first direction through charging and the development cycle. Development or toning station 16 is maintained in the raised position during this time by eccentrically shaped toning station cam 85 being in the raised position shown so that the cam 85 forces up against cam receiving plate 89. Cam 85, as best seen in FIGS. 2 and 3, is rotated between its off-centered raised position and its lowered position by a rotational clutch 88, drive chain 87 and cam drive sprocket 86. Once transfer roller 42, moving in the first direction, has passed over development electrode 31, and depressant corona 29, bearing stop block 57 strikes retractable pin 62, as seen in FIGS. 3 and 4 to hold the backing plate 41 stationary opposite or over the development station 16. At this time the transfer roller 42 separates from the web backing plate 41.

The separation is effected by the master transport assembly 34 being driven by the master transport assembly drive motor 106 and its associated main drive screw shaft 35 until the stop block 57, with its bearing 39, contact retractable pin 62, whose air cylinder 96 of FIG. 1 is mounted to an angle iron support rail 69. Transfer roller bearings 56 are driven by transfer roller drive screw rod 36 via drive screw 108 and its associated transfer roller drive bracket 109 until the pivot arms 55 are driven with bearings 56 into contact with stop pins 94. This causes the pivot arms 55, only one of which is shown and which are spring loaded by tensioning springs 49, to rotate about pins 54, thereby causing the transfer roller guide means 50 to raise up out of retention grooves 52, best seen in FIGS. 4 and 5. Carrier web backing plate 41 and its attached ramp plates 51 are held in place by the contact of stop block 57 with retractable pin 62 as the master transport assembly 34 is driven in the first direction by drive screw shaft 35 and its drive motor 106 toward platen 22 until the master transport assembly's stop bracket 38 contacts it. Although there are two transfer roller bearings 56, pivot arms 55, tensioning springs 49, pins 54, retention grooves 52 and ramp plates 51, only one of each are shown in the FIGURES since the FIGURES are side views.

Until this separation the transfer roller 42, with its guide roller 50, remains seated in the retention groove 52 of ramp plate 51. After separation, the transfer roller 42 is held in its raised position by being driven against contact pin 94, as seen in FIGS. 3 and 4. The entire transfer means, indicated generally by the numeral 53 in FIGS. 2 and 3, is driven along bearing support shaft 37 by transfer roller drive screw rod 36. Bearing support shaft 37 is reinforced by reinforcement member 43.

The engagement of bearing stop block 57 with retractable pin 62, and the subsequent separation of the transfer roller 42 and the web backing plate 41, causes the web backing plate 41 to keep the carrier web 40 generally flat and a uniform distance from the toning station 16 during the entire development cycle. During the development cycle, excess solvent is removed from the area around the developed image by the reversing roller 30, in conjunction with the depressant corona 29. Upon completion of the development cycle, retractable pin 62 is retracted upwardly to allow web backing plate 41 to continue to traverse in the first direction until it is directly over cleaning station 18.

During this portion of the operation of apparatus 10, the cleaning station 18 is in a lowered position so that the cleaning roller 71 and the web wiper 77 do not interfere with the master 48 as it is enroute to the transfer operation. Although not specifically shown, cleaning roller 71 is driven by drive roller 73 (FIGS. 2 and 3). After the image has been transferred to the conductive receiving surface 23, the cleaning station 18 is cammed to a raised position by cam 75 (FIGS. 2 and 3) utilizing a rotational clutch (not shown). As the master transport assembly 34 moves in a direction to move the master 48 over the conductive receiving surface 23, it engages the wicking station 19 to move it across the conductive receiving surface 23. Referring to FIGS. 9–14, the wicking station 19 includes a wicking station frame 200 mounted for movement on the machine frame by linear ball bearings 202. The frame 200 includes left and right hand side portions 204 as viewed in FIG. 9. An adjustable slip clutch 206 is mounted on the left-hand side portion 204 of the frame 200 as viewed in FIG. 9 and has a drive shaft 208 extending therefrom across the apparatus. The shaft 208 is supported in insulating bushings 210 of any suitable dielectric material which are mounted in the side portions 204 of the frame 200.

A gap strip tension and drive motor 212 is mounted on the inside of left-hand side portion 204 of the frame 200 and has its output shaft 214 connected to the slip clutch 206 by means of a pair of drive gears 216 and 218, one, 216 of which, is attached to the drive motor output shaft 214 and the other, 218 of which, is connected to the slip clutch 206.

Gap strip drive pulleys 220 are drivenly attached to the drive shaft 208 adjacent to the inside of each of the side portions 204 of the frame 200. An idler shaft 222 extends across the wicking station 19 below the drive shaft 208 and has its end portions rotatably mounted in the side portion 204 of the frame 200 by bushings 224. Gap strip idler pulleys 226 fabricated from a suitable dielectric material are rotatably mounted on the shaft 222 beneath the drive pulleys 220.

In the case where a conductive receiving surface is used, the gap strips 26 are preferably constructed in two layers 230 and 232 are partially shown in FIGS. 13 and 14. The bottom layer 230 is an electrically insulating layer formed from a dielectric material such as polyester or other suitable dielectric material. The top layer 232, which is bonded to the bottom layer 230, is an electrically conductive layer formed from an electrically conductive material such as aluminum, copper, silver paste, or the like. The dielectric layer 230 is wider than the conductive layer 232, as shown. Additionally, at one end of each of the gap strips 26, the conductive layer 232 terminates short of the dielectric layer 230 forming electrically isolated end 234 while at the other end, the conductive layer 232 extends to end of the dielectric layer forming an electrically conductive end 236.

The electrically conductive end 236 of each of the gap strips 26 is attached to a gap strip drive pulley 220 so that the conductive layer 232 is electrically connected thereto. Each gap strip 26 wraps around a respective idler pulley 226 and has its electrically isolated end 234 connected to the support plate 238 of the cleaning station 18. The conductive layer 232 faces downwardly as the gap strips 23 pass between the idler pulleys 226 and the support plate 238. A transfer voltage connection 239 is attached to one end of the drive shaft 208. The connection 239 is connected to a suitable power source and control system (not shown) so that an electrical charge may be applied to the drive shaft 208. The electrical charge is conducted through the shaft 208, the gap strip drive pulleys 220 which are fabricated from an electrically conductive material to the electrically conductive layer 232 of the gap strips 26. As the gap strips 26 are constructed such that the dielectric layer 230 is wider than the electrically conductive layer 232, the high voltage on the edges of the conductive receiving surface is prevented from arcing across to the ground plane of the master.

The wicking station 19 also includes a spray bar 240 for dispensing a layer of liquid containing a non-polar insulating solvent on the receiving surface 23. The spray bar 240 extends between the side portion 204 of the frame 200 in front of a metering roller 242. The metering roller 242 is connected at each end to one end of a lever arm 244 positioned on the inside of side portion 204 of the frame and which has its other end attached to the idler shaft. Second lever arms 246 and 248 are attached to each of the ends of the idler shaft outside of the side portions 204 of the frame 200. The right-hand lever arm 248, as viewed in FIG. 9, has its other end attached to a metering roller actuator in the form of an air cylinder 250 which is attached to the side portion 204 of the frame 200 as shown in FIG. 12. Mounted on each side portion 204 of the frame 200 are adjustable cams 252 positioned to be engaged by the arms 246 attached to the idle shaft when the metering roller 242 is moved downwardly as shown by the dotted line in FIG. 11. A 3-way valve 254 is attached to the frame 200 of the wicking unit 19 and is positioned in the supply line (not shown) to the spray bar 240 for controlling the supply of liquid to the spray bar 240 and insuring an instant supply thereto. An air knife 256 is also mounted on the wicking station 19 to remove excess solvent from the conductive receiving surface 23 after image transfer.

Figure 9:
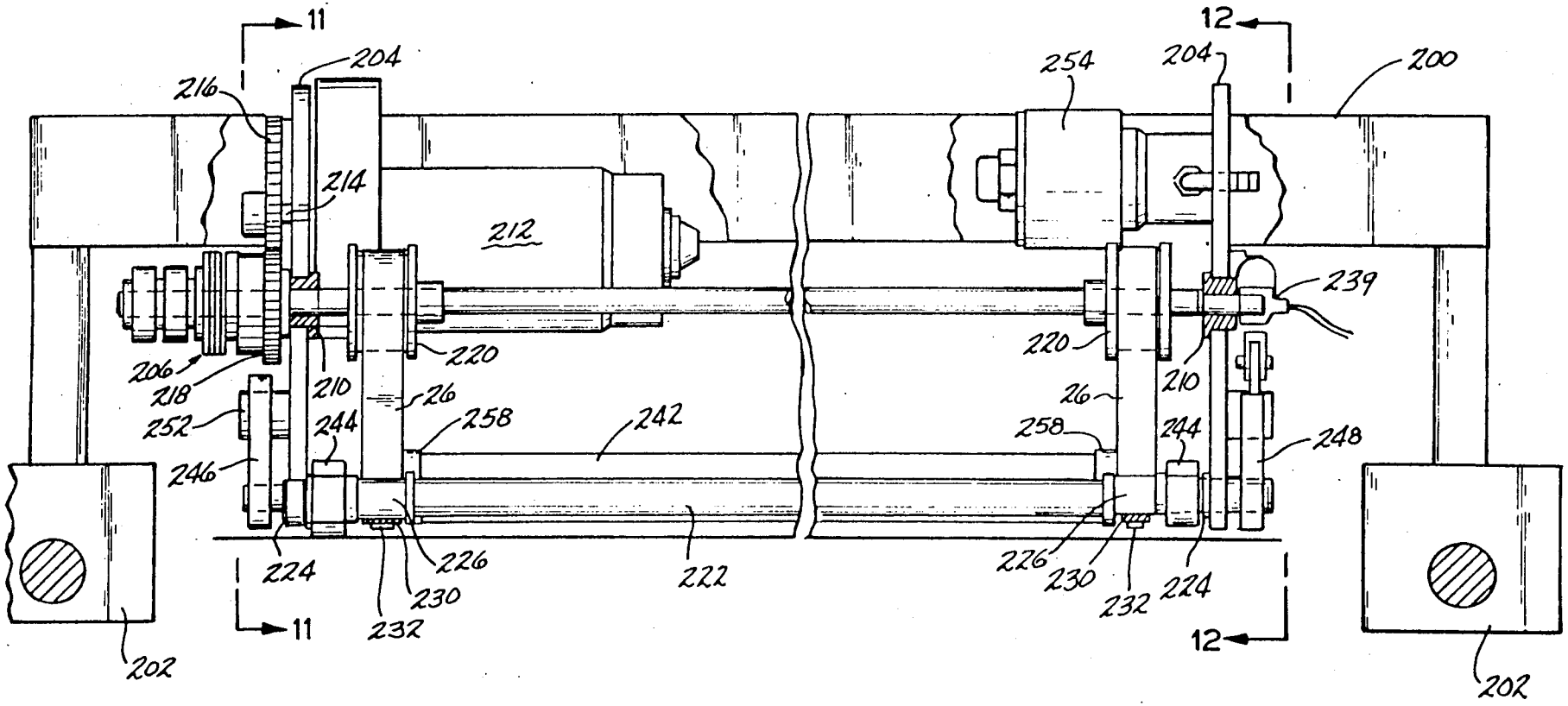
FIG. 9 is an enlarged partial elevation view, partially in section of the wicking station, taken generally along the lines 9—9 of FIG. 2.
Figure 10:
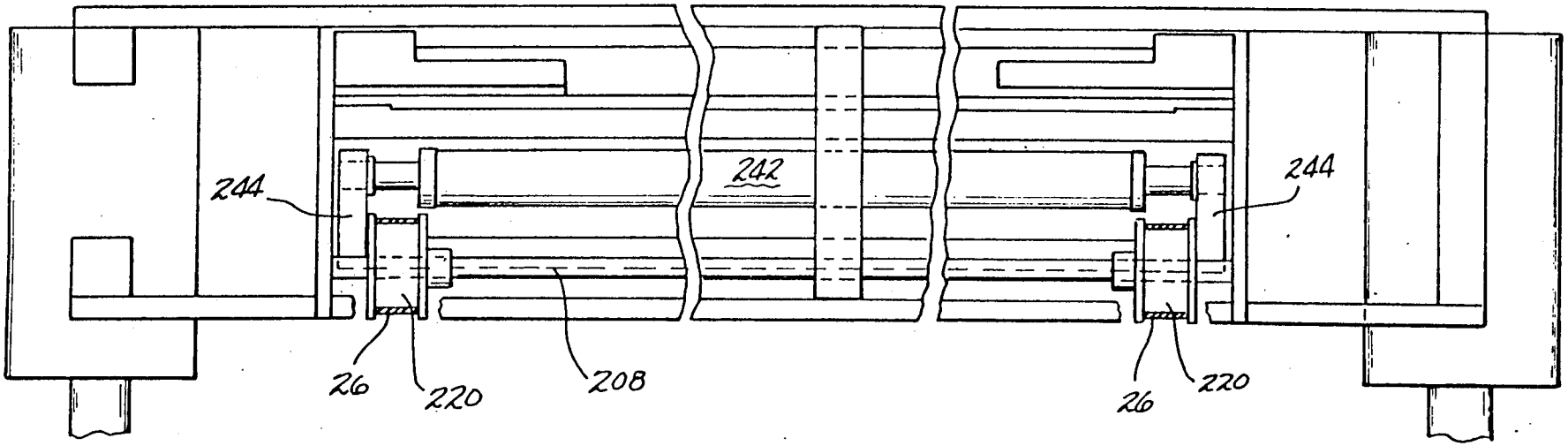
FIG. 10 is a top plan view of the wicking station shown in FIG. 9.

The metering roller 242 is provided with a gap spacer 258 in the form of enlarged diameter end portions as shown in FIGS. 9 and 10. The enlarged end portions 258 are adapted to physically engage the edge of the receiving surface. The cams 252 serve to adjust the lower position of the metering roller to provide for various thicknesses of the image receiving surfaces and the machine tolerances.

As the wicking station 19 is moved from its first position adjacent the cleaning station across the receiving surface 23 to its second position, the gap spacer strips 26 are played out from the drive pulleys 220 across the surface of the image receiving surface 23. As the gap strip tension drive motor 212 is continuously actuated, a slip clutch 206 permits the gap strip drive pulleys to be unwound in the opposite direction from the normal driving direction. However, the drive motor 212 does maintain a constant tension on the gap strips 26 is determined by the slip clutch 206 which is adjustable. Also during this movement, the spray bar 240 supplies a stream of non-polar insulating solvent onto the image receiving surface before the image transfer. The three way fluid valve 254 provides a means for ensuring an instant supply of solvent to the spray bar 240 as the valve 254 is mounted on and moveable with the wicking station 19. The amount of solvent supplied to the image receiving surface is greater than that required to fill the gap required for transfer. The metering roller 242 passes over the receiving surface 26 with the end portions 258 in physical engagement therewith to evenly distribute the deposited solvent. The weight of the metering roller 242 holds it in physical engagement with the receiving surface. The gap defined between the roller itself and its enlarged end portions determines the height of the solvent layer. The gap strips 26 provide a physical gap between the master and the receiving surface. The thickness of the gap strips is determined by the topography of the image receiving surface.

The master transport assembly 34 of FIG. 5 stops when the master 48 on the carrier web means 40 is positioned precisely over the conductive receiving surface 23 on the platen 22, so that the master 48 precisely overlies the receiving surface 23. The transfer roller 42 is then lowered into position, so it is ready to perform the transfer operation which is accomplished by traversing on the top side of the carrier web means 40 in the opposing second direction.

Figure 8:
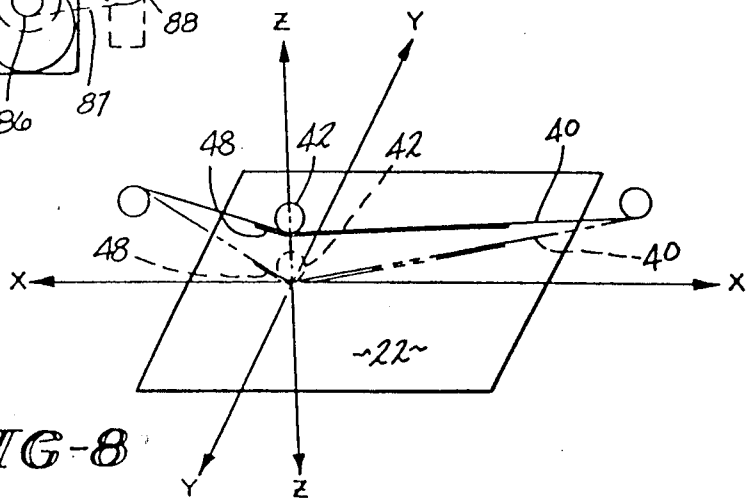
FIG. 8 is a diagrammatical illustration showing the only movement between the developed master and the receiving surface is in the vertical direction along the Z axis and that no movement occurs in the horizontal X and Y planes.

As seen in FIG. 2, the master transport assembly 34 has electrically grounded web tensioning roller means 45 mounted on an idler arm 46 that is moveable by means of the spring 47 to cause the roller means 45 to turn about a suitable support, such as a bearing (not shown), to maintain the proper tension on the carrier web means 40. Once properly positioned, the transfer roller 42 contacts the back or upper side of the carrier web means 40 and traverses in the opposing second direction a distance equal to at least the length of the master 48 to bring the master adjacent to, but not in contact with, the conductive receiving surface 23 at discrete points along the entire length of the master 48. The only movement of the master 48 on the carrier web means 40 is in the vertical direction along the Z axis, as is diagrammatically illustrated in FIG. 8.

Figure 6:
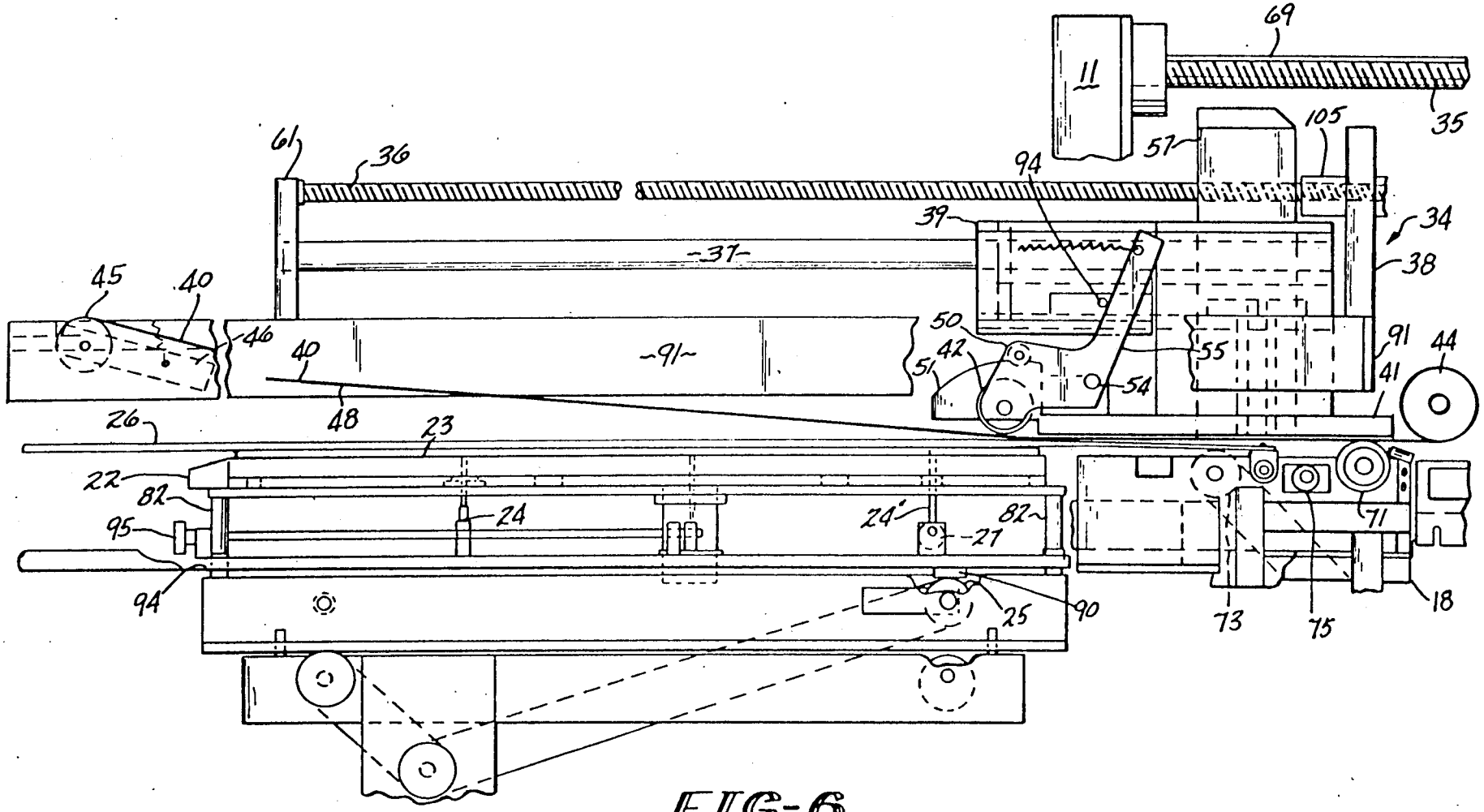
FIG. 6 is an enlarged side elevational view of the apparatus at the end of the transfer cycle after the developed image has been transferred from the electrostatic master to the receiving surface.

FIGS. 5 and 6 show the position of the transfer roller 42 at the beginning and at the end of the transfer operation in contact with the carrier web means 40. FIG. 5 shows the apparatus at the beginning of the transfer cycle with the transfer roller 42 in its lowered position. FIG. 6 also shows how the transfer roller guide means 50 rides up the ramp plate 51 into the retention groove 52 at the end of the transfer operation.

Figure 7:
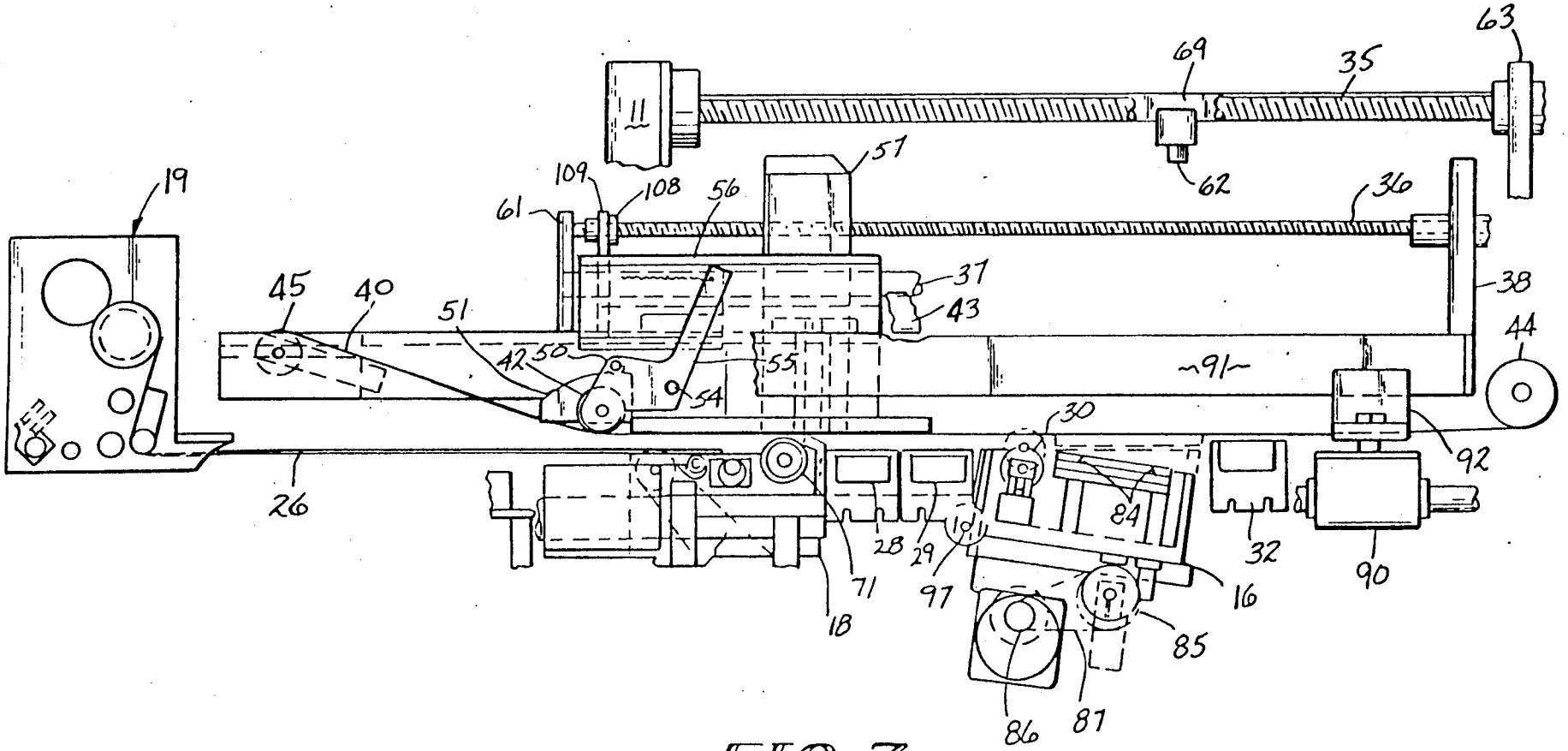
FIG. 7 is an enlarged side elevational view of the apparatus showing a position at the end of the cleaning cycle.

Web retention roller means 44 of FIG. 7 applies the high voltage charge, varying from about 200 to about 3,000 volts, dependent upon the master, to the conductive surface of the carrier web means 40 to pick up and retain the master 48 on the carrier web means 40. Web retention roller means 44 combines with the tensioning roller means 45 and the transfer roller 42 to permit the transfer roller 42 to smooth out the carrier web means 40 and the master 48 to obtain a smooth, continuous surface that is free of ripples.

As is best seen in FIG. 5, the transfer roller 42 establishes with the carrier web means 40 a leading angle and trailing angle. These leading and trailing angles vary as the transfer roller traverses the entire length of the master 48. The leading angle and the trailing angle will vary in angulation depending upon the diameter of the transfer roller, the speed of travel of the transfer roller across the carrier web means 40, the length of the master 48, the size of the transfer gap between the master 48 and the receiving surface 23, and the type of toner used. The leading angle can vary from between about 1° to about 10° from the front at the beginning of contact with the master 48 to about 6° to about 30° at the end of the master 48. Similarly, the trailing angle can vary from between about 45° down to about 22 ½° at the beginning of contact with the master 48 to about 22 ½° to about 10° at the end of the master 48. For example, with a 1 ½ inch diameter transfer roller, a 24 inch long master, a transfer roller traversing speed of about 10 inches per second and about a 5 mil thick transfer gap, the leading angle was about 1° at the beginning of contact with the master 48 and about 6° at the end of the master 48. The trailing angle at these two locations varied between about 22 ½ to about 12°. As a general guide, it is not desirable to use a larger than necessary angle for the leading and trailing angles.

The transfer roller 42, with the web tensioning roller means 45 and the web retention roller means 44, maintain a uniform tension on the carrier web means 40 to ensure discrete point to point transfer of the developed image on the master to the conductive receiving surface through a transfer window and to avoid entrapping air and excessive non-polar insulating liquid solvent between the two surfaces. The transfer window is that area on the master 48 which the diameter of the transfer roller brings into transfer proximity for discrete point transfer with the receiving surface 23.

The gap between the two surfaces is filled with the non-polar insulating solvent across which the toner particles travel. The size of the gap is determined by the thickness of the gap spacing strips 26 if the gap spacing strips 26 are placed on the receiving surface 23.

The electrostatic field between the master 48 and the conductive receiving surface 23 is established by the application of a charge on the conductive receiving surface 23. This charge is supplied by the transfer voltage connection 240 which is connected to an independent high voltage source (not shown). The transfer voltage connection 239 applies electrical charge to the drive shaft 208 which conducts the charge through the gap strip drive pulleys 220 to the electrically conductive layer 232 of the gap strips 26 which are in contact with the conductive receiving surface 23. This electrostatic field permits a transfer of the developed image on the master 48 to the conductive receiving surface 23.

As the master 48 is returned in the opposite direction to its first position away from the receiving surface 23 after image transfer, the gap strips 26 serve to provide a means for returning the wicking station to its initial start position. This is achieved by the drive motor 212 driving the shaft 208 to rotate the drive pulleys 220 in the direction indicated by the arrow whereby the guide spacer strips are taken up around the pulley, pulling the wicking unit 19 toward its first position adjacent to the cleaning station. The variable speed gap strip tension drive motor 212 allows the wicking unit to be returned to its initial position at a different speed (slower) then the return speed of the master. This feature allows the wicking unit 19 which includes the air knife 256 to transverse the transferred image at the proper speed whereby the air knife can remove the excess solvent residing on top of the transferred image. Additionally, as the wicking unit 19 begins its return to its initial position, the air cylinder 250 lifts the metering roller off the image receiving surface to prevent the metering roller from smearing the transferred image.

FIG. 7 shows the position of the master transport assembly 34 with the transfer means 53 and its carrier means backing plate 41 held stationary in position opposite the cleaning station 18. The cleaning station 18 is shown in its raised position, while the development station 16 is shown pivoted about pin 97 to its lowered position and clear of the path of the master 48 and the flexible carrier means 40. The development station is shown in dotted lines in its raised position.

In operation, a master 48 is placed on the platen 22 and registered. During this operation, the gap spacing strips 26 must be detached. Accordingly, the means of attachment of the ends 234 to the support plate 238 should be of a type to permit the ends 234 to be easily detached. The permanent master 48 has previously had its photosensitive surface exposed to obtain the difference in electrical resistivity required for the process by the cross-linking of the exposed surface area to obtain the permanent latent image desired. This cross-linked exposed surface area has increased electrical resistivity.

A dummy receiving surface or punch guide (not shown) that is the same thickness as the receiving surface 23 is placed on the platen 22. The master 48 is then placed atop the dummy receiving surface. The four alignment pins 24 are then raised to register the master 48 and the dummy receiving surface to the platen 22. Once this is properly registered via the pins 24, the vacuum pump apparatus 15 is activated to hold both the dummy receiving surface and the master 48 in place.

The master transport assembly 34 positions the carrier web 40 over the master 48 and the carrier web 40 is registered to the platen 22 and the master 48, with the use of platen pins 24 and alignment pins 33. An electrical charge is applied to the conductive surface of the flexible carrier web 40 to pick up and hold the master 48 in the registered position on the web 40. The master transport assembly 34 then return the carrier web 40 and the master 48 to the right-most position of FIG. 1 on support frame 11.

The board or conductive receiving surface feed unit 21 then picks up a receiving surface 23 and places it on the platen 22 where it is registered in position via the desired alignment pins 24 and 24' and, depending upon the size of the receiving surface 23, pins 24'' or 24'''. Once properly positioned, the master transport assembly 34 begins its traverse in the first direction along guide rails 17 with the master 48, bringing the master 48 over the charge corona 32 to have the master 48 charged. The master 48 and the carrier web 40 continue traversing in the first direction to bring the master 48 over the development station 16, with its development electrode 31. The flexible carrier web backing means or plate 41 remains positioned over the development electrode 31 as the transfer means 53 has transfer roller 42 separate from the retention groove 52 at the top of ramp plate 51 after stop block 57 contacts retractable pin 62. The master transport assembly 34 continues to transport the master 48 over the reversing roller 30 and depressant corona 29.

The disengagement of the transfer roller 42 from the retention groove 52 allows the flexible carrier means or web backing plate 41 to be driven in the opposite direction against stop bracket 38. This is accomplished by actuating the retractable stop pin 62, mounted to the support bracket 69, in front of stop block 57 as the master transport assembly 34 is driven in the first direction towards the platen 22 of FIG. 1 by the main drive screw shaft 35. After the web backing plate 41 abuts stop bracket 38, the retractable stop pin 69 is retracted to a raised position and a rotational clutch is disengaged and permits the development station 16 to pivot downwardly about a shaft to a lowered position (not shown). The flexible carrier means or web backing plate 41 is now in the transfer position. The transfer roller 42 is then in position to traverse the flexible carrier means 40 in the opposing second direction to effect the electrostatic transfer from the master 48 to the receiving surface 23.

The receiving surface 23 is wicked by wicking station 19, applying non-polar insulating solvent to it from spray bar 76, as the gap spacing strips 26 are fed out along its opposing edges. A charge is then applied to the receiving surface 23, and the developed image on the permanent master 48 and the receiving surface 23 are then ready for image transfer utilizing the transfer roller 42.

The transfer roller 42 traverses the entire length of the master 48 by being driven in the opposing second direction along bearing support shafts 37 of FIG. 5 (only one of which is shown) by a transfer roller drive motor 105, turning transfer roller drive screw rod 36, which drives screw 108 and its associated transfer roller drive bracket 109. Once the transfer roller 42 has traversed the entire length, guide roller 50 rides up the ramp plate 51 into the retention groove 52 as the bearing stop block 39 engages the stop bracket 38. The ramp plate 51 is suitably connected to carrier backing means or web backing plate 41. This positioning of the guide roller 50 continues until the entire master transport assembly 34 is moved back in the opposing second direction to the start position seen in FIG. 1 and the cleaning operation described below has been completed. The riding of the guide rollers 50 up the ramp plate 51 cause the pivot arms 55, connected to bearing 56 to pivot about pins 54 to raise the transfer roller 42 up and allow the carrier web means 40 to be flat against the web backing plate 41.

Once the transfer operation has been completed the master cleaning station 18 of FIG. 6 is cammed up to its raised position by the aforementioned cam 75 to permit the master 48 to be cleaned prior to the next image transfer. Cleaning station 18 is then raised against carrier web 40, which is in contact with web backing plate 41. Cleaning station 18 employs a cleaning roller 71, and a spray bar (not shown) to apply a coating of solvent to the master 48 and then remove any excess. A web wiper 77 may also be used to clean the master 48 as part of the cleaning station 18 after image transfer has occurred. Cleaning occurs by movement of the master 48 and the master transport assembly in the opposing second direction after the transfer roller 42 has been reseated in retention groove 52.

Web backing plate 41 and the carried transfer roller 42 are held over the cleaning station 18 during the entire cleaning cycle by the drive motor 105 turning transfer roller drive screw rod 36 to drive the transfer roller 42 and web backing plate 41 towards stop plate 61 of FIG. 1 as master transport assembly 34 is driven at the same speed in the opposing second direction to its starting position against master transport assembly stop plate 63 of FIG. 7. The master 48 is discharged by discharge corona 28 prior to the master transport assembly 34 returning to its starting position. The imaged receiving surface 23 is then removed by pickup apparatus 20 and platen 22 is ready for receipt of another receiving surface 23 from feeder unit 21.

The use of the term permanent latent image with respect to the master 48 is intended to connote that the image is durable, lasting over a long period of time, as well as not changing in the high quality and resolution of its transferred image. For example, the permanent latent image can last months and, perhaps, years once exposed into the electrostatically imageable surface of the master 48, under proper storage conditions. Additionally, as many as 5,000 images have been transferred from a single master.

While the preferred structure in which the principles of the present invention have been incorporated is shown and described above, it is to be understood that the invention is not to be limited to the particular details thus presented but, in fact, widely different means may be employed in the practice of the broader aspects of this invention.

For example, the apparatus is equally well employable with conductive or non-conductive receiving surfaces. Also, in the case where non-conductive receiving surfaces are used, the gap spacing strips do not have to include the electrically conductive layer and may serve the sole purpose of returning the wicking station to its initial portion in combination with the drive motor. The scope of the appended claims is intended to encompass all obvious changes in the details, materials and arrangements of parts that will occur to one of ordinary skill in the art upon a reading of this disclosure.

What is claimed is:

1. An apparatus for transferring a developed image from a master having a permanent latent image therein to a receiving surface comprising, a) a frame assembly, b) means for moving said master on said frame assembly from a first position to a second position whereat said master and said receiving surface are in overlapping relationship for transferring the image to said receiving surface and for returning said master to its first position, after image transfer, c) a moveable member, d) gap spacers in the form of elongated strips mounted in said moveable member and extendable therefrom with the and extending from said moveable member attached to said frame, e) means for moving said moveable member from a first position wherein the gap spacers are remote from said receiving surface to a second position wherein said gap spacers extend over said receiving surface as said master moves to its second position so the gap spacers are positioned between said receiving surface and said master to maintain a gap there between during transfer of the image, and f) means for returning said moveable means to its first position from its second position at a speed independent of the speed of said master as it returns to its first position from its second position.

2. The apparatus of claim 1 wherein the speed of return of said moveable means is slower than said speed of return of said master.

3. The apparatus of claim 1, said means for returning includes takeup means in said moveable means for taking up said gap spacers, a drive motor for actuating said takeup means to take up said gap spacers to move said moveable means from its second position to its first position in a direction toward the end of the gap spacers fixed to said frame.

4. The apparatus of claim 3 further including a slip clutch interposed between said drive means and said takeup means whereby said gap strips can be played out in tension as said moveable means is moved from its first position to its second position while said drive motor is operable.

5. The apparatus of claim 4, wherein said takeup means comprises a drive shaft and a drive pulley for each of said gap spacers attached to said shaft, said gap spacers having their other end attach to a respective pulley, said drive means driving said drive shaft through said clutch member whereby said gap spacers are wound about said pulley to return said moveable member to its first position.

6. The apparatus of claim 5 wherein said slip clutch is adjustable to set the amount of tension on the gap spacers.

7. An apparatus for transferring a developed image from a master having a permanent latent image therein to a receiving surface comprising, a) a frame assembly, b) means for moving said master on said frame assembly from a first position to a second position whereat said master and said receiving surface are in overlapping relationship for transferring the image to said receiving surface and for returning said master to its first position, after image transfer, c) a moveable member, d) gap spacers in the form of elongated strips mounted in said moveable member and extendable therefrom with the end extending from said moveable member attached to said frame, e) means for moving said moveable member from a first position wherein the gap spacers are remote from said receiving surface to a second position wherein said gap spacers extend over said receiving surface as said master moves to its second position so the gap spacers are positioned between said receiving surface and said master to maintain a gap there between during transfer of the image said gap spacers including a first layer of dielectric material and a second layer of electrically conductive material, said electrically conductive material being positioned on the side of each said gap spacer to engage said receiving surface when said gap spacers extend over the receiving surface, the width of the electrically conductive layer on said gap spacers being less than the width of the dielectric layer, and f) means for imparting an electrical charge to said gap spacers through said moveable member, said electrical conductive layer on said gap spacers being isolated from said frame.

8. An apparatus for transferring a developed image from master having a permanent latent image thereon to a receiving surface comprising, a) a frame assembly, b) means for moving said master on said frame in a first direction from a first position remote from said receiving surface to a second position whereat said master and said receiving surface are in overlying relationship and for moving said master in a second direction to return it to its first position after image transfer, c) a wicking station moveable on said frame assembly from a first position to a second position in the direction movement of said master from its first position to its second position during which said wicking station passes over said receiving surface to deposit a non-conductive solvent on said receiving surface, and returnable in a second direction to its first position, and d) means for moving said wicking station in said first direction, and means for moving said wicking station from the second position to its first position in the second direction of movement of said master at a speed independent of the speed of said master.

9. The apparatus of claim 8 where the speed of movement of said wicking station from its second position to its first is slower than the speed of return of said master.

10. The apparatus of claim 9 wherein said wicking station contains an air knife for removing excess solvent from the receiving surface upon movement of the wicking station from its second position to its first position.

11. The apparatus of claim 8 further including gap spacers in the form of elongated strips mounted in and extendable from said wicking station and having an end extending therefrom, said end attached to said frame, said gap strips being played out as said wicking station moves from its first position to its second position whereby said gap spacer strips extend over said receiving surface as said master moves to its second position so the gap spacers are positioned between the receiving surface and the master to maintain a gap therebetween during transfer of the image.

12. The apparatus of claim 11 further including a metering roller to distribute the solvent onto said receiving surface as said wicking station moves from its first position to its second position.

13. The apparatus of claim 12 wherein said metering roller includes large diameter portions in engagement with the receiving surface and the lesser diameter portion for distributing said solvent.

14. The apparatus of claim 13 further including means for lifting said metering roller from said receiving surface when said wicking station moves from its second position to its first position.

15. The apparatus of claim 12 wherein said metering roller is mounted on a lever and further including adjustable means for engagement by said lever for adjusting the lower most position of the metering roller.

16. The apparatus of claim 8 further including means for dispensing solvent onto said receiving surface, and valve means for controlling the flow of solvent to said dispensing means, said valve being mounted on and moveable with said wicking station.

17. The apparatus of claim 11 wherein said ends of said gap spacer strips are detachably connected to said frame.

* * * * *